US006005209A

United States Patent [19]

Burleson et al.

[11] Patent Number: 6,005,209

[45] Date of Patent: Dec. 21, 1999

[54] THIN KEYBOARD HAVING TORSION BAR KEYSWITCH HINGE MEMBERS

[75] Inventors: Winslow Scott Burleson, Palo Alto; William Marvin Dyer, San Jose; Christopher Karl Eisbach, Mountain View, all of Calif.; Derek Solomon Pai, Bellevue, Wash.; Edwin Joseph Selker, Palo Alto, Calif.

[73] Assignee: International Business Machines Corporation, Armonk, N.Y.

[21] Appl. No.: 08/979,341

[22] Filed: Nov. 24, 1997

[51] Int. Cl.[6] ..... H01H 13/52; H01H 13/70

[52] U.S. Cl. ..... 200/343; 200/517

[58] Field of Search ..... 200/5 R, 5 A, 200/511–517, 341–345; 400/472, 490, 491, 495, 495.1, 496

[56] References Cited

U.S. PATENT DOCUMENTS

| | | | |
|---|---|---|---|
| 4,032,729 | 6/1977 | Koistenen | 200/5 A |
| 4,620,075 | 10/1986 | La Belle et al. | 200/159 B |
| 4,689,455 | 8/1987 | Watanabe | 200/340 |
| 5,131,308 | 7/1992 | Katsuta | 84/434 |
| 5,278,372 | 1/1994 | Takagi et al. | 200/344 |
| 5,280,147 | 1/1994 | Mochizuki et al. | 200/344 |
| 5,329,079 | 7/1994 | English et al. | 200/5 A |
| 5,329,084 | 7/1994 | Watanabe et al. | 200/344 |
| 5,382,762 | 1/1995 | Mochizuki | 200/5 A |
| 5,457,453 | 10/1995 | Chiu et al. | 341/22 |
| 5,481,074 | 1/1996 | English | 200/5 A |

*Primary Examiner*—Michael Friedhofer

*Attorney, Agent, or Firm*—McGinn & Gibb, P.C.; Richard Ludwin, Esq.

[57] ABSTRACT

A keyboard apparatus is provided for small and lightweight computers and the like. Keyswitches and a keyboard assembly comprise a sheet member having a plurality of key faces fixed thereon in a conventional keyboard arrangement. A plurality of cutouts are provided in the sheet member, partially surrounding each key face. A living hinge member is provided in the sheet member at one side of each key face. Each living hinge member includes a base section, an intermediate section, and a key face section. The former two and the latter two sections each interface at a living hinge. Depressing the key face causes the key face section to pivot about the living hinges to operate a corresponding set of electrical contacts, indicating operation of the key. A conventional rubber spring may transmit the pivot motion of the key face to the electrical contacts. The living hinges are made to have a greater resilience and flexibility than those of the sections, such as by scoring, scribing, perforation, or other suitable treatment. Accordingly, the intermediate section is able to serve as a torsion bar, advantageously limiting the key's freedom to twist under the user's finger pressulr.

20 Claims, 6 Drawing Sheets

THIN KEYBOARD HAVING TORSION BAR KEYSWITCH HINGE MEMBERS

FIELD OF THE INVENTION

The invention generally relates to the field of computer user interface technology. More specifically, the invention relates to keyboards. The invention has particular applicability to portable computers.

BACKGROUND OF THE INVENTION

GENERAL BACKGROUND ART

Keyboards are essential input devices for many applications, including for personal computers. As described above, such personal computers are often designed to be transportable and have been occupying less cubic volume over time. An example of such a portable personal computer is described in coassigned U.S. Pat. No. 5,198,991, incorporated by reference herein for the purpose of describing the computer per se and the connections between the computer and a folding keyboard, and such description will not be repeated here.

The miniaturization of data processing equipment, for portability and ease of use, is becoming increasingly important. However, there are some factors which place practical limits on the miniaturization which could theoretically be achieved.

The limiting factor for reducing the size of portable data processing equipment is generally the keyboard. A keyboard requires sufficient size, in terms of horizontal dimensions, for the keys. Keys are constrained to at least a certain minimum size, because they must have a size and spacing commensurate with the size of an average operator's fingers and hands.

Keyboards also requires mechanics, for converting keystrokes to electrical signals representative of operation of the keys. Some minimum thickness must be provided for these components. Also, the keys preferably have enough vertical displacement to give the user a good tactile feel.

Some conventional keyboards, particularly full-size desktop computer keyboards, have used mechanics such as "chimneys," sleeves that slide up and down. Such structures provide the advantage that all parts of the key are stable pressing down. That is, the key is constrained to a single, vertical translational degree of freedom, so the key presses down in a vertical fashion.

Another conventional structure that of using scissors that use two members that pivot at the center and are attached at one end and the other end of them slides a lot, one can achieve pressing anywhere on the key (pressing the key vertically up and down.

Prior U.S. Pat. No. 5,280,147, Mochizuki et al., assigned to Brother Kogyo Kabushiki Kaisha, reduces the thickness of the keyboard by the use of scissors-like pivotally connected support levers with pivot connections at one end of each lever to respectively the base and the key, and sliding pivot connections at the opposite ends. A conventional nonlinear rubber spring or "dome" is used to transmit the keystroke to electrical contacts to make the connection, indicating operation of the key.

These mechanisms are fine for desktop keyboards, when there is vertical space to be had. However, they are less suitable for portable computers. Such computers are designed for small size and light weight. In particular, reducing the thickness, and producing a "thin" keyboard, has been an important design objective. For such thin keyboards where there is little vertical space, other mechanisms have been used.

A typical portable data processor, or "portable personal computer" or "personal digital assistant", has a keyboard panel and a display panel, and the data processor is incorporated within one of the panels. The two panels are then folded together so that the bottom of the keyboard panel and the back of the display panel form an outer case for the folded unit. By reducing the thickness of the keyboard, the thickness of the overall folded unit may also be reduced, making the folded portable data processing unit easier to handle and to carry.

Prior U.S. Pat. No. 5,457,453, Chiu et al., unassigned, illustrates a keyboard having reduced thickness when folded, by moving otherwise conventional plunger keys to depressed positions when folding is to occur.

UNITED STATES PATENT APPLICATION 08/801,833

Co-pending, co-assigned U.S. patent application Ser. No. 08/801,833, Selker et al., "Thin Keyboard," describes keyswitches and a thin keyboard assembly. This co-pending patent application is hereby incorporated by reference. As background information for the present patent application, the apparatus described in the '833 application will be described here, in some detail. FIGS. 1, 2, 6, 7, and 8 of the '833 application are reproduced as FIGS. 1, 2, 3, 4, and 5, respectively, of the present patent application The assembly comprises a sheet member having a plurality of key faces fixed thereon in a conventional keyboard arrangement, a plurality of cutouts in the sheet member partially surrounding each key face, and a plurality of living hinges in the sheet member at one side of each key face, whereby the key face may be depressed, causing the key face to pivot about the living hinges to operate a corresponding set of electrical contacts, indicating operation of the key. A conventional rubber spring may transmit the pivot motion of the key face to the electrical contacts.

Two embodiments are given, one comprising a planar sheet with a single living hinge at one side of each key, whereby depression of the key face causes the key face to pivot downward about the living hinge. The other embodiment comprises two living hinges at one side of each key, allowing the key face to remain level while the pivoting about both hinges, which key requires a lower force to be operated.

Referring to FIG. 1, a keyboard assembly 10 is comprised of a plurality of key faces 11 arranged in rows according to the conventional "QWERTY" format. A face plate 12 covers the spaces of the keyboard assembly between the key faces. Electrical lines 14 and 15 extend from the keyboard assembly for connection to a data processor, as will be described. A base plate of the keyboard and the face plate 12 are connected together about the periphery of the keyboard as shown by edges 50 and 51.

THE FIRST EMBODIMENT OF THE '833 APPLICATION

FIG. 2 illustrates, in greatly expanded scale, the first of the embodiments of the '833 application. A planar sheet 20 extends under the face plate 12 of the keyboard assembly of FIG. 1. The planar sheet preferably comprises a plastic material having both aspects of flexibility and of stiffness. The preferred material is Mylar.

One of the keyfaces 11 is affixed to and supported by the planar sheet 20. A cutout 22, forming a hinge member, extends partially around the keyface 11, on three sides thereof. Each end, or terminus, of the cutout 22 may be squared off, or, preferably, comprises a rounded terminus 23 and terminus 24.

The termini of the ends of the cutout are connected by a living hinge 26, forming a center section 28 of the planar sheet. A "living hinge," by the way, is a section of a member which is, in some way, treated or modified so that, where mechanical stress is applied to the member, bending or other strain occurs at the living hinge section, in preference to occurring in other sections of the member. By contrast, other types of hinges are separate components coupled to members so as to bend, responsive to applied stress, without making it necessary for the other members themselves to bend.

Thus, depression of the keyface 11 causes the keyface and center section 28 to pivot downward, rotating about the living hinge 26. The living hinge is a natural consequence of the positioning of the termini 23 and 24, but alternatively may be etched or cut into the planar sheet 20.

This structure provided structural stability, in that the hinge acts as a torsion bar. By bending at only one point, this hinge did not allow a long key to twist. It was secured by the press down below the hinge by a piece of plastic that sandwiched on top of the Mylar, and above the hinge there is a bending piece by a piece of plastic that is the key top. In that way it could not twist.

Unfortunately, the pressure required at one end of the key (at the top of the key) was much lower than at the bottom of the key where the hinge was made. The difference between 200 grams and 50 grams was measured. In fact, if one pressed very close to the hinge, one would imagine that there would be no motion at the hinge if you press on the hinge itself.

THE SECOND EMBODIMENT OF THE '833 APPLICATION

FIGS. 3, 4 and 5 illustrate, in greatly expanded scale, a second embodiment of the invention described in the '833 application. This alternative sheet member and keyswitch arrangement required a substantially reduced actuation force. The actuation force for the keyswitch arrangement of FIG. 2 is approximately 80 grams, whereas the arrangement of FIGS. 3–5 is approximately 60 grams. The smaller actuation force is the preferred embodiment of the invention for a "light touch" keyboard.

Referring to FIGS. 3–5, the sheet member 70 extends under the spacer 46 of the keyboard assembly of FIG. 1. The planar sheet 70 is the same material as planar sheet 20, preferably comprising a plastic material having both aspects of flexibility and of stiffness, such as Mylar. One of the keyfaces 11 is affixed to and supported by the planar sheet 70.

A cutout 72 extends partially around the keyface 11, on three sides thereof, and forms a first living hinge 73. The cutout 72 continues inward, towards the center of the key 11 to form a terminus 75 and a terminus 76. The termini of the ends of the cutout are connected by a second living hinge 77, under the keyface 11.

The cutout 72 thereby forms a center section 28 of the planar sheet, forming a hinge member. The hinge member includes a key face section, a center or intermediate section, and a base section, and two living hinges 73 and 77 at which the sections interface.

Thus, depression of the keyface 11 causes the keyface and center section 78 to stay level and pivot about the living hinges 73 and 77, moving forward slightly, to move from the quiescent, unactuated position of FIG. 4 to the depressed, actuated position of FIG. 5.

The living hinges 73 and 77 are a natural consequence of the positioning of the cutout 72 and the termini 75 and 76, but alternatively may be etched or cut into the planar sheet 70.

The mechanism of FIGS. 3–5 preferably is implemented as a Mylar double hinge. By having the hinge off a piece of Mylar be a line that bends, then a segment that does not bend, and another line that bends, followed by a piece of plastic on top to hold the key, the back of the key requires the same force to press down, even though it is close to the hinge.

Unfortunately, a drawback was found that the Mylar no longer acted as a torsion bar. Because the entire cutout hinge member has a constant resiliency, depressing a key causes unstable flexing of the hinge member. Therefore, this sort of conventional keyswitch has a disadvantageous tendency to twist. As a result, user tactile feel is poor.

Another drawback, related to the manufacturing process for such keyswitch assemblies is that the etching or cutting of the sheet 70 to make the living hinges is manufacturing step separate from other steps of the process, and therefore disadvantageously adds to the length and complexity of the manufacturing process.

Accordingly, there is room for further improvements in key apparatus technology, so as to provide the desired torsion and even pressure requirements, while also being thin and lightweight enough for use with portable computers and being advantageously easy to manufacture.

SUMMARY OF THE INVENTION

It is therefore an object of the invention to provide a key structure for a thin keyboard which provides torsion-bar stability.

It is a further object of the invention to provide a key structure that is responsive to a substantially constant user fingertip pressure, regardless of which part of the key upon which the fingertip pressure is concentrated.

To achieve these and other objects, there is provided, in accordance with the invention, a keyswitch apparatus for producing a signal representative of a symbol, responsive to manipulation, by a user, of a keyboard key corresponding with the symbol.

The keyswitch apparatus according to the invention comprises the following components:

Electrical contact members are provided, having normally separated contacts, which make electrical contact when the keyswitch assembly is vertically compressed.

A hinge member is provided, made of a thin sheet of material, preferably Mylar. The hinge member is preferably cut out from the sheet of material, to have one side connected to the remainder of the sheet, and the other sides detached from the sheet.

The hinge member has three sections, a base section including the side still connected to the remainder of a sheet, an intermediate section adjacent to the base section, and a key face section adjacent to the intermediate section and farthest from the connection to the remainder of the sheet. The key face section of the hinge member supports a key face affixed thereon.

A first axis forms a boundary between the base and intermediate sections, and a second axis forms a boundary between the intermediate and key face sections. The sections of the hinge member are pivotable about the first and second axes.

The hinge member is made of a thin material having a first resiliency. The base section and the intermediate section interface at a first living hinge along the first axis. The key section interfaces with the intermediate section at a second living hinge along the second axis.

In accordance with the invention, the first and second living hinges having a second resiliency which is greater than the first resiliency.

Accordingly, when the key face is pressed, the hinge member pivots about the first and second axes to make the electrical contact between the electrical contact members, and the intermediate section, having its low resiliency, relative to that of the hinges, acts as a torsion bar to restrain the key face from twisting when pressed.

It has been found that a prototype keyswitch device according to the invention both provides the desired torsion bar stability for the overlying key, and also is responsive, evenly, to the users fingertip pressure, regardless of upon what part of the key the fingertip pressure is concentrated.

DESCRIPTION OF THE PREFERRED EMBODIMENT

In general, a keyswitch according to the invention includes a hinge member supporting a key face affixed thereon. When the key face is pressed, the hinge member pivots about the first and second axes to make electrical contact between electrical contact members.

The hinge member is pivotable about first and second horizontal axes intersecting the hinge member. The hinge member is made of a thin material, preferably a Mylar sheet. The hinge member, for the most part, has a first resiliency.

The hinge member includes a base section and an intermediate section which interface at a first living hinge along the first axis. The hinge member further includes a key section which interfaces with the intermediate section at a second living hinge along the second axis.

In accordance with the invention, the first and second living hinges have a second resiliency which is greater than the first resiliency. That is, when the keyswitch is depressed, the hinge member flexes at its high-resiliency living hinges, while remaining substantially unflexed at the base, intermediate, and key sections. Because the intermediate section is not flexed, it is able to act as a torsion bar to restrain the key face from twisting when pressed.

The discussion which follows will present several specific embodiments of the invention, in which various techniques are used for bringing about the relatively high resiliency of the living hinges, in accordance with the invention. Therefore, the invention includes both the keyswitch product having the structural characteristics just described, and the manufacturing process used to make the keyswitch, and particularly to make the hinge member described.

Note that, for the purpose of the discussion which follows, the term "resiliency" is broadly construed as an antonym of "rigidity," to include any variant idea such as flexibility, etc. The material should be such that it will not wear out, crack, etc., in a reasonable lifetime, "reasonable" being measured in terms of a number of flexes likely to be encountered in the useful lifetime of a product, such as a computer, employing keyswitches according to the invention. It is preferable, but not essential, that the highly resilient material have a "memory," in that after a flexing force is removed, the material reverts back to its shape prior to the exertion of the flexing force.

FIRST EMBODIMENT

Figure 1:
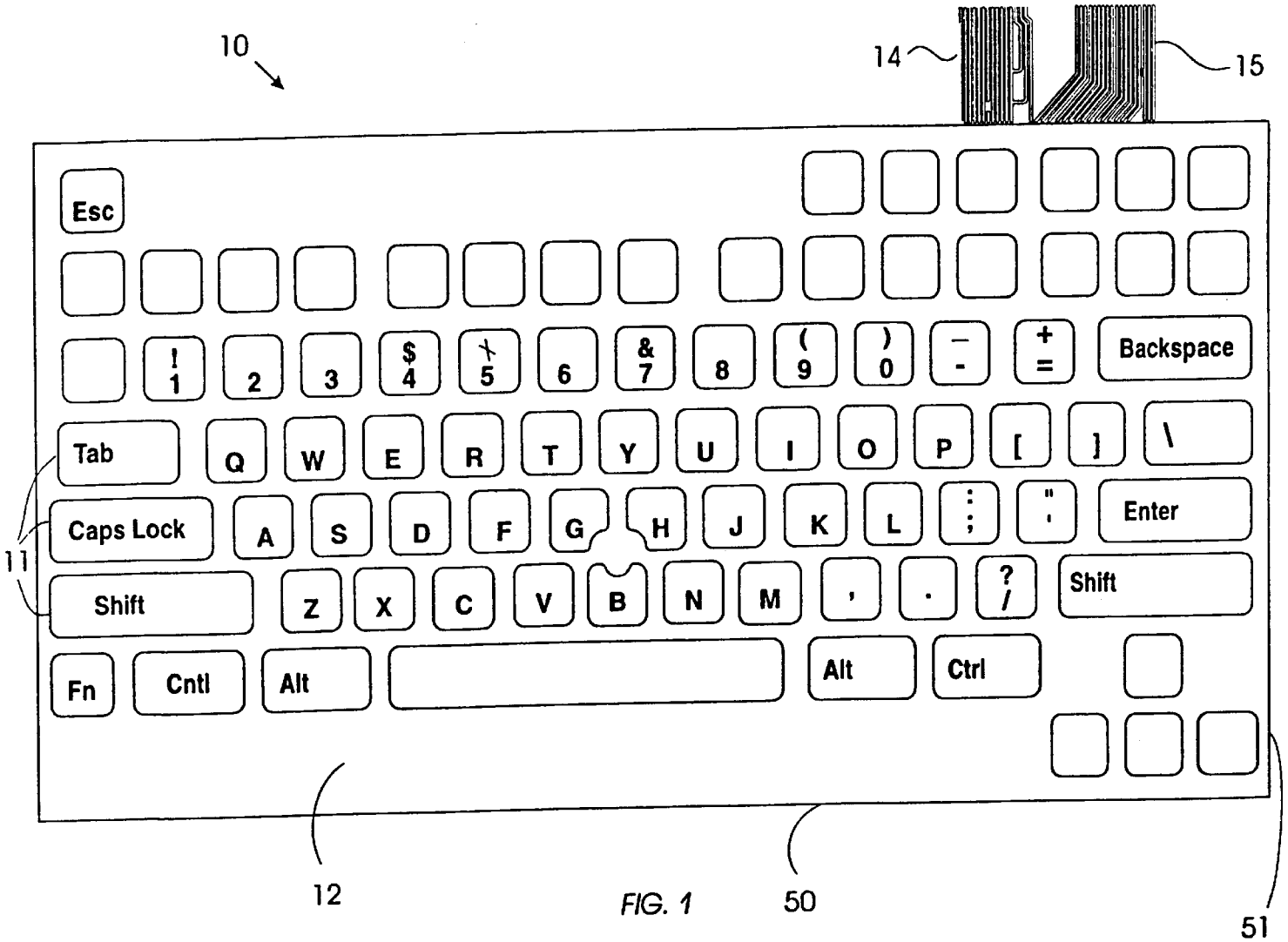
FIG. 1 is a perspective view of a keyboard assembly with which the present invention is to be used.
Figure 2:
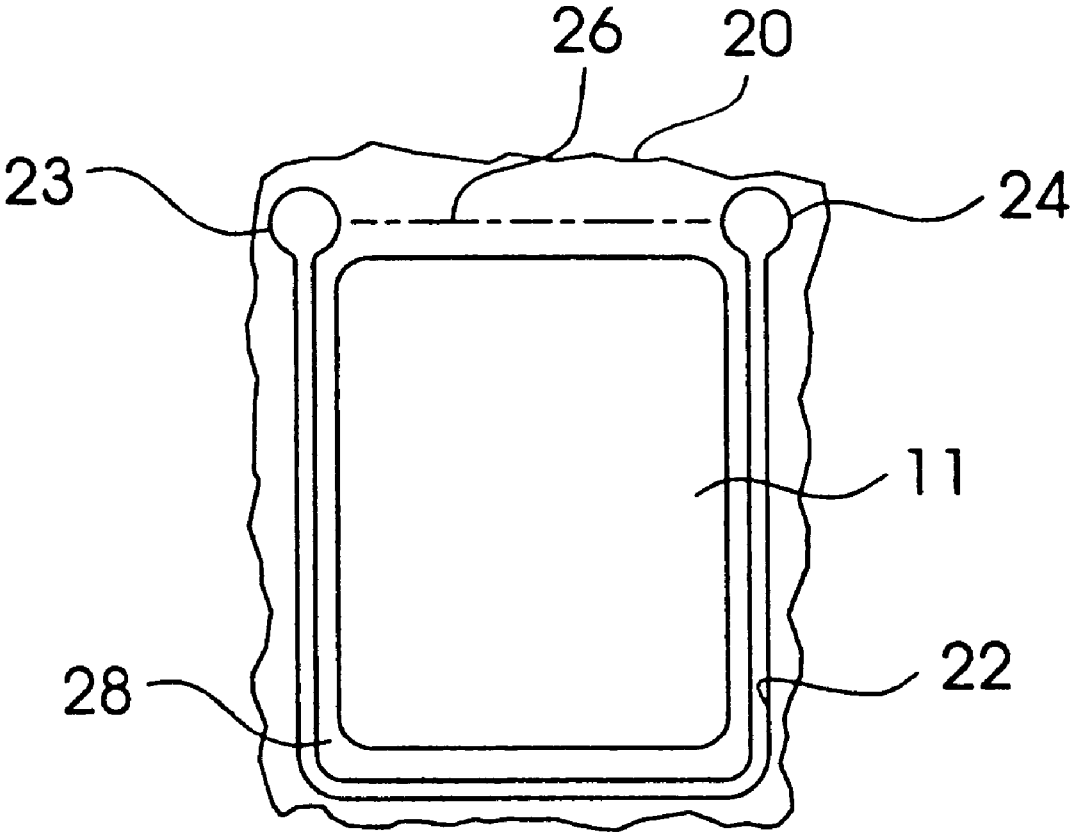
FIG. 2 is a top view of a planar sheet for one key of a first prior art keyboard assembly.
Figure 3:
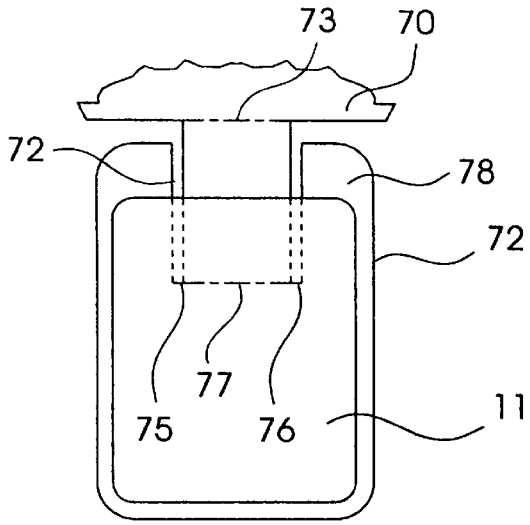
FIG. 3 is a top view of a planar sheet for one key of a second prior art keyboard assembly.
Figure 4:
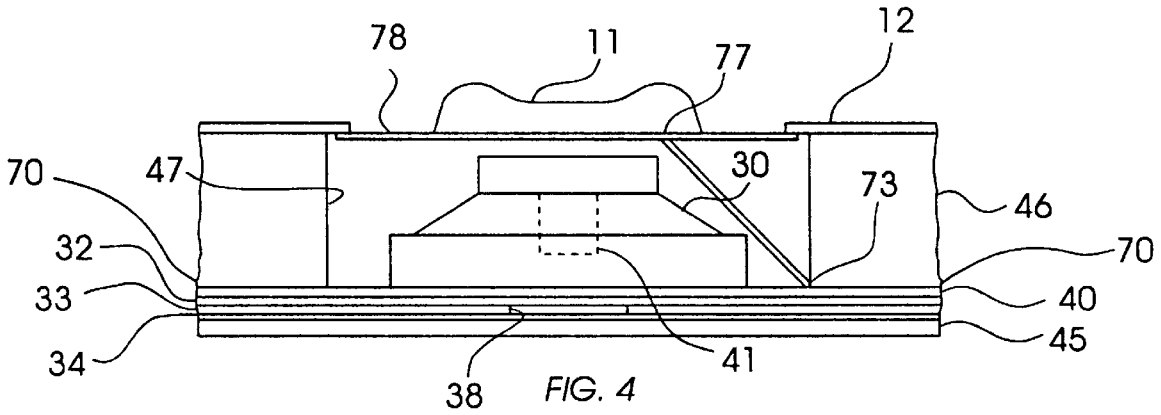
FIG. 4 is a front elevational view of the prior art keyswitch assembly of FIG. 3, partly in section.
Figure 5:
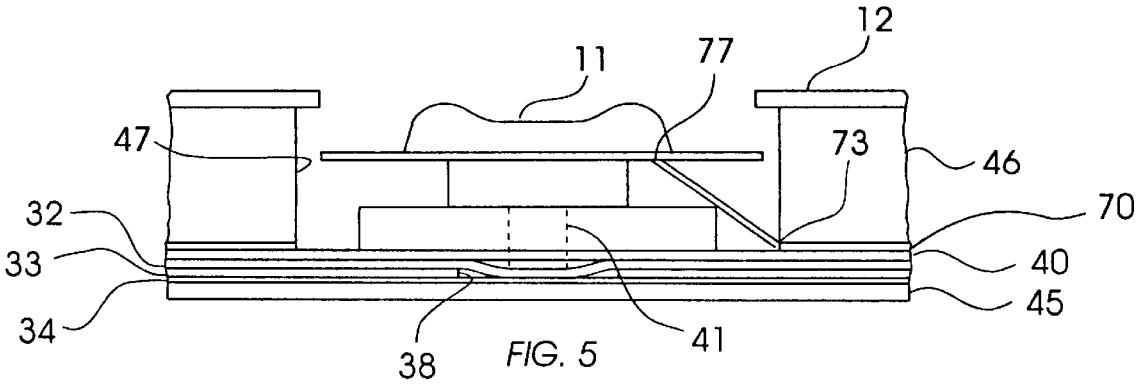
FIG. 5 is a side elevational view of the keyswitch assembly of FIG. 3, partly in section.
Figure 6:
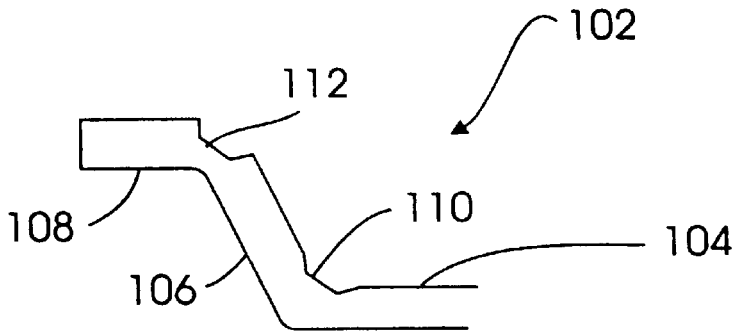
FIG. 6 is a side view of a first embodiment of the invention in a quiescent position.
Figure 7:
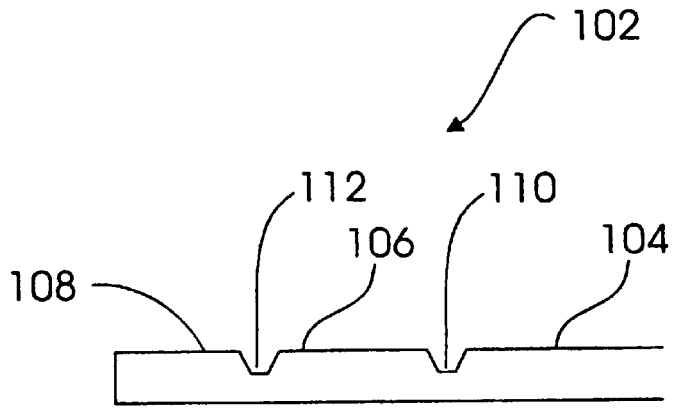
FIG. 7 is a side view of the first embodiment of the invention in a position wherein the key has been depressed.

A first preferred embodiment is illustrated in side edge views in FIGS. 6 and 7. In the first embodiment, the first and second hinges are scribed or scored, during a manufacturing process. In FIG. 6, the hinge member is shown in a quiescent (bent) condition. In FIG. 7, the hinge member is shown as flexed (flattened), responsive to the keyswitch being depressed.

A hinge member 102 is shown, including a base section 104, an intermediate section 106, and a key section 108. A first kerf 110 is shown at the first hinge between the base section 104 and the intermediate section 106. A second kerf 104 is shown at the second hinge between the intermediate section 106 and the key section 108. ("Kerf," by the way is synonymous with "slit" or "notch.")

The kerfs 110 and 112 increase the resiliency of the hinges, relative to that of the base, intermediate, and key sections 104, 106, and 108, to make it much easier for the hinge member to bend at the kerfs 110 and 112 than to bend at the intermediate section 106. As a consequence, the keyswitch of the invention, taken as a whole, has advantageous torsional rigidity.

The kerfs 110 and 112 are preferably made, during the manufacturing process, after the hinge member has been cut out from the sheet of Mylar. The scoring or scribing may be performed automatically at the time of the cutting out, or may be done afterward, either by machine or by hand. A pointed tool such as a scribing tool, may be drawn across the length of the hinge. Alternatively, a blade, pressed down upon or drawn across the hinge, may be used.

The depth of the kerfs 110 and 112 preferably are such as will produce the desired increase in resiliency, but will not be so deep as to cause the hinge member to have an undesirably short lifetime, lifetime being measured in terms of the number of flexes the hinge member can make before it breaks at the hinges. The width of the kerfs 110 and 112 is preferably related to the thickness of the Mylar sheet. However, the particular dimensions are not deemed critical to the invention, but rather may be freely selected for suitability to particular applications.

The kerfs 110 and 112 are shown as both on the same side of the hinge member, but they may be on opposite sides as appropriate to achieve the desired high resiliency.

SECOND EMBODIMENT

Figure 8:
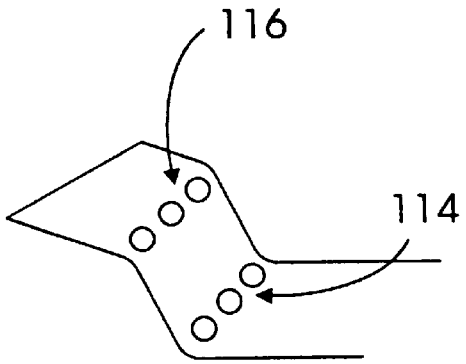
FIG. 8 is a perspective view of a second embodiment of the invention in a quiescent position.
Figure 9:
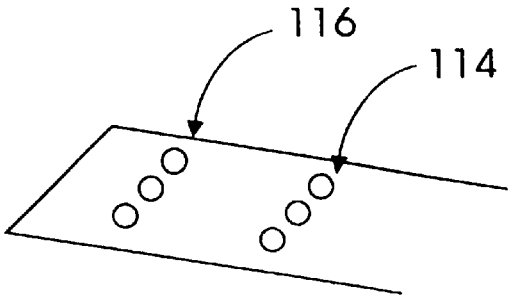
FIG. 9 is a perspective view of the second embodiment of the invention in a position wherein the key has been depressed.

A second embodiment of the invention is shown in FIGS. 8 and 9. Again, views are shown both of the hinge member in a quiescent (bent) condition (FIG. 8), and in a flexed (flattened) condition, responsive to the keyswitch being depressed (FIG. 9).

In the second preferred embodiment, perforations, shown as holes 114 and 116, are made through the hinge member at the first and second living hinges. The perforations are preferably made during a manufacturing process which also includes cutting out the hinge member from the thin sheet of material.

The holes of the second embodiment are regarded as the preferred embodiment of the invention, because they are easily manufacturable by the same mechanisms that would punch the slots that separate the Mylar key areas (that is, the hinge members) from the Mylar stabilizing areas.

In particular, a preferred embodiment for a Mylar sheet of 0.01" thickness, circular holes 0.03" in diameter, spaced 0.06" apart, have been found to facilitate good living hinges for keyswitches of overall sizes suitable for use in computer keyboards.

While even spacing of the holes, and the use of circular holes, are preferred (and intuitive) modes of practicing the invention, spacing need not be even, and the holes need not be round. More broadly, the holes may be of any generally regular, generally convex shape, such as squares, hexagons, ovals, etc.

For the purpose of the preceding paragraph, "generally regular" is intended to mean that the width of the hole, regardless of the angle measured, is within a desired threshold value of the same. For instance, a circular hole meets this definition, because regardless of the angle of measurement, the width, i.e., the diameter, is the same value. A square could also be regarded as meeting this criterion, a side being of unit length, measured at one angle, and a diagonal, being 45 degrees away from the angle of the side, and having a length of the square root of two units, if the difference of a factor of the square-root-of-two falls within the threshold.

"Generally convex" is intended to comport with the mathematical definition of a convex region, that any line segment, connecting any two points within the convex region, falls entirely within the region. However, holes which deviate from this definition of "generally convex" are within the spirit and scope of the invention, as long as the shape of the hole does not unduly facilitate cracking or tearing of the thin sheet with repeated flexing of the material.

Also, based on manufacturing criteria or the particular torsional characteristics of certain types of keyswitches, variations may be practiced within the spirit and scope of the invention.

Figure 10:
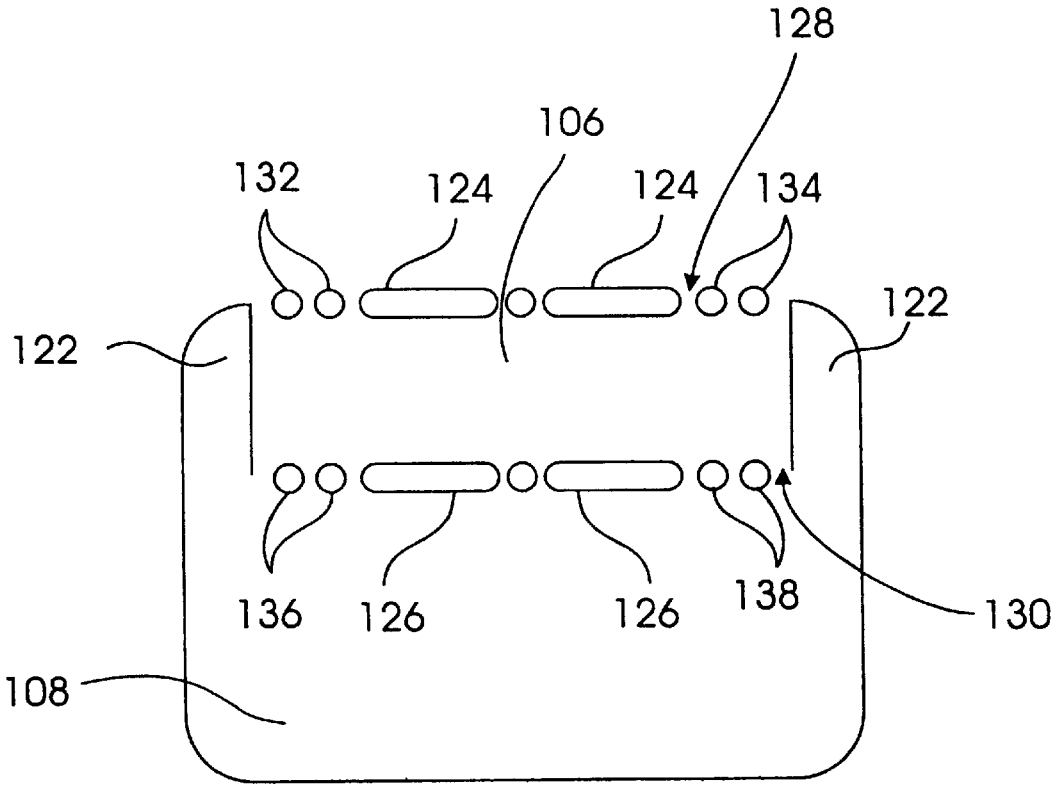
FIG. 10 is a top view of a variant of the second embodiment of the invention.

Such variations are illustrated by a related embodiment, shown in FIG. 10. For keys with elongated widths, such as space bars, it has been found that holes elongated along the axes of the living hinges, shown as holes 124 and 126, provide increased resiliency for first and second living hinges 128 and 130, respectively. It has further been found that, where elongated holes are used, torsional stability of the elongated key is improved by providing one or more smaller holes, shown as circular holes 132, 134, 136, and 138, at the ends of the living hinges, and by positioning the elongated holes 124 and 126 nearer the middle of the living hinges.

THIRD EMBODIMENT

Figure 11:
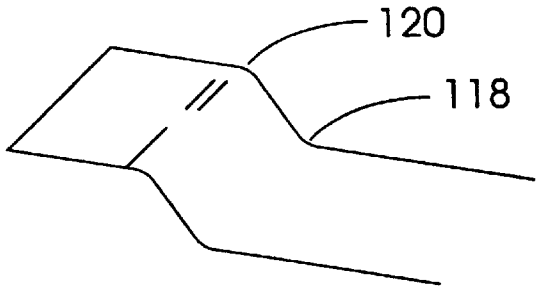
FIG. 11 is a perspective view of a third embodiment of the invention in a quiescent position.

FIG. 11 illustrates a third embodiment of the invention, in which the manufacturing process includes a way of treating the material making up the hinge member, to increase the resiliency at hinges 118 and 120. Various means are within the contemplation of the invention, depending on the characteristics of the sheet of material from which the keyswitch cutouts are to be made. For instance, optical, thermal or chemical treatment may bring about a chemical change in the makeup of the material, leading to greater resiliency.

The illustrations of the invention given in FIGS. 6, 7, 8, 9, 10, and 11 are schematic in nature, and are intended to illustrate the basic idea of the invention, rather than necesarily showing a realistic image of how the invention would be used, and what the dimensions of the embodiments would be.

Figure 12:
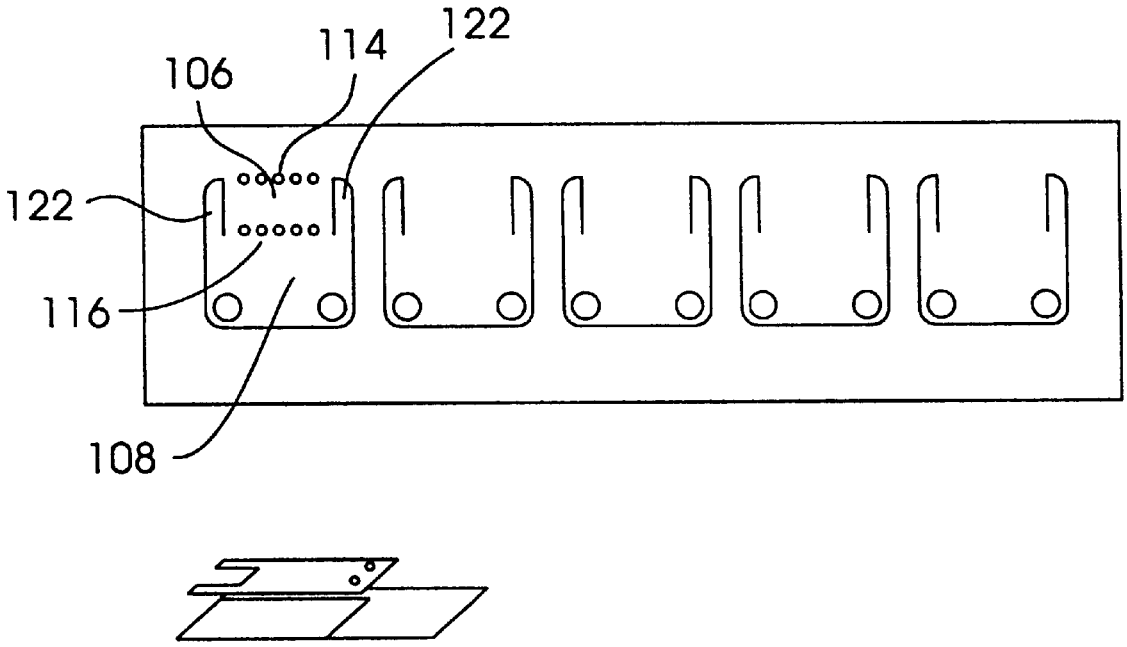
FIG. 12 is a top view of an array of cutouts, in a sheet of thin material, for implementing an array of adjacent keyswitches in accordance with the invention.

In FIG. 12, there is shown an array of hinge members, which would be made in a sheet of thin material to be used in a keyboard supporting a corresponding array of keyswitches. For illustrative purposes, perforations 114 and 116 as per the second embodiment (FIGS. 8, 9, and 10) are illustrated and pointed out. In this illustrated embodiment, the key section 108 includes arms 122 which are cut out on either side of the intermediate section 106. This particular shape illustrates one of many possible basic cutout designs which may be used in accordance with the invention.

The use of such perforations, in particular, advantageously allows the functionality of a keyswitch to be facilitated through the use of only one piece of material, namely the thin sheet into which the cuts are made. Furthermore, the process of manufacturing the keyswitches from a plain sheet of thin material is advantageously simplified, in that the perforations may be cut into the thin material at the same time as the other cuts. For instance, a suitably shaped die may be used to stamp out the cuts, including the perforations, all in one stroke.

Finally, it has been found that cuts with dimensions suitably chosen to match key sizes in otherwise conventional keyboard designs and layouts work well in commercially available thin sheet materials, such as Mylar sheets.

All of the above embodiments have been shown to make the resultant keyswitch apparatus less susceptible to twisting and acting as a low-quality key than is the case with conventional devices.

Note, additionally, that keyswitches according to the invention may be constructed, further including domes of resilient material such as rubber. The domes serve as springs to bias the keyswitch upward, and to provide tactile feedback to the user. The use of such domes is known, and therefore domes are omitted from the accompanying drawings. However, keyswitches according to the invention have been found advantageously to stabilize the keys, so that, even though there is only a small vertical stroke of a key, the user's tactile feel is advantageously good.

While the preferred embodiments of the present invention have been illustrated in detail, it should be apparent that modifications and adaptations to those embodiments may occur to one skilled in the art without departing from the scope of the present invention as set forth in the following claims.

What is claimed is:

1. A keyswitch assembly comprising:

electrical contact members having normally separated contacts, which make electrical contact when the keyswitch assembly is vertically compressed; and a thin sheet of resilient material having a cutout hinge member, the hinge member pivotable about first and second horizontal axes intersecting the hinge member, the hinge member having a first resiliency, the hinge member including a base section and an intermediate section which interface at a first living hinge along the first axis, the hinge member further including a key section supporting a key face affixed thereon, said key section interfacing with the intermediate section at a second living hinge along the second axis, the first and second living hinges having a second resiliency which is greater than the first resiliency, wherein the base section defines a first plane and the key section defines a second plane substantially parallel to said first plane when said hinge member is in a quiescent condition, said intermediate section defining a third plane traverse to said first plane and said second plane when the hinge member is in said quiescent condition;

whereby, when the key face is pressed, the hinge member pivots about the first and second axes to make the electrical contact between the electrical contact members, and the intermediate section acts as a torsion bar to restrain the key face from twisting when pressed.

2. A keyswitch assembly as recited in claim 1, wherein the first and second living hinges have a chemical makeup, as a result of one of (i) optical treatment, (ii) chemical treatment, and (iii) thermal treatment, which results in the second resiliency.

3. A keyswitch assembly as recited in claim 1, wherein the hinge member has perforations at the first and second living hinges.

4. A keyswitch assembly as recited in claim 3, wherein the perforations are evenly spaced along the first and second living hinges.

5. A keyswitch assembly as recited in claim 3, wherein the perforations are circular.

6. A keyswitch assembly as recited in claim 3, wherein the perforations include perforations elongated along the first and second axes.

7. A keyswitch assembly as recited in claim 3, wherein the perforations include a combination of generally regular perforations and perforations elongated along the first and second axes.

8. A keyswitch assembly as recited in claim 7, wherein:

the living hinges each have ends and a middle; and the perforations include generally regular perforations near the ends of the first and second axes, and elongated perforations near the middles of the first and second axes.

9. A method for producing a keyswitch assembly from a thin sheet of resilient material having a first resiliency, the method comprising the steps of:

cutting out a keyswitch keyface hinge member from the sheet of material, the keyface hinge member having a base section and an intermediate section which interface at a first living hinge along the first axis, the hinge member further including a keyface section which interfaces with the intermediate section at a second living hinge along the second axis, the base section including a side still connected to a remainder of the sheet, the key face section being farthest from the connection to the remainder of the sheet, wherein the base section defines a first plane and the keyface section defines a second plane substantially parallel to said first plane when said hinge member is in a quiescent condition, said intermediate section defining a third plane traverse to said first plane and said second plane when the keyface hinge member is in said quiescent condition; and increasing the resiliency of the first and second living hinges to a second resiliency greater than the first resiliency.

10. A method as recited in claim 9, wherein the step of increasing the resiliency includes changing a chemical makeup of the material at the first and second living hinges.

11. A method as recited in claim 10, wherein the step of changing the chemical makeup includes of one of (i) optical treatment, (ii) chemical treatment, and (iii) thermal treatment.

12. A method as recited in claim 9, wherein the step of increasing the resiliency includes making perforations in the hinge member at the first and second living hinges.

13. A method as recited in claim 12, wherein the step of making perforations is executed concurrently with the step of cutting out.

14. A method as recited in claim 12, wherein the step of making perforations includes making perforations that are evenly spaced along the first and second living hinges.

15. A method as recited in claim 12, wherein the step of making perforations includes making perforations that are circular.

16. A method as recited in claim 12, wherein the step of making perforations includes making perforations that are elongated along the first and second axes.

17. A method as recited in claim 12, wherein the step of making perforations includes making a combination of generally regular perforations and perforations elongated along the first and second axes.

18. A method as recited in claim 17, wherein:

the living hinges each have ends and a middle; and the step of making perforations includes making generally regular perforations near the ends of the first and second axes, and making elongated perforations near the middles of the first and second axes.

19. A keyswitch assembly comprising:

electrical contact members having normally separated contacts, which make electrical contact when the keyswitch assembly is vertically compressed;

a resilient material having a cutout hinge member, the hinge member supporting a key face affixed thereon and pivotable about first and second horizontal axes intersecting the hinge member, the hinge member having a first resiliency, the hinge member including a base section and an intermediate section which interface at a first living hinge along the first axis, the hinge member further including a key section which interfaces with the intermediate section at a second living hinge along the second axis, the first and second living hinges having a second resiliency which is greater than the first resiliency, wherein the first and second living hinges have a chemical makeup, as a result of at least one (i) optical treatment, (ii) chemical treatment, and (iii) thermal treatment, which results in the second resiliency;

whereby, when the key face is pressed, the hinge member pivots about the first and second axes to make the electrical contact between the electrical contact members, and the intermediate section acts as a torsion bar to restrain the key face from twisting when pressed.

20. A method for producing a keyswitch assembly from a resilient material having a first resiliency, the method comprising:

forming a keyswitch keyface hinge member from the material, the keyface hinge member having a base section and an intermediate section which interface at a first living hinge along the first axis, the hinge member further including a keyface section which interfaces with the intermediate section at a second living hinge along the second axis, the base section including a side connected to a remainder of the sheet, the key face section being farthest from the connection to the remainder of the sheet; and increasing the resiliency of the first and second living hinges to a second resiliency greater than the first resiliency, wherein the step of increasing the resiliency includes changing a chemical makeup of the material at the first and second living hinges.

* * * * *